United States Patent [19]

Johnson

[11] 3,969,026

[45] July 13, 1976

[54] WAXING AND POLISHING APPARATUS

[76] Inventor: Jerry W. Johnson, 5351 Bechtol Court, Marion, Ind. 46952

[22] Filed: Apr. 21, 1975

[21] Appl. No.: 570,272

[52] U.S. Cl. ..... 401/37; 401/196

[51] Int. Cl.[2] ..... A47L 13/26

[58] Field of Search ..... 401/196, 201, 26, 37, 401/38; 220/4 B, 4 E

[56] References Cited

UNITED STATES PATENTS

| | | | |
|---|---|---|---|
| 362,109 | 5/1887 | Puellmann | 401/37 |
| 1,497,199 | 6/1924 | Sutthoff | 220/4 B X |
| 2,223,343 | 12/1940 | Grant | 401/37 |
| 2,945,250 | 7/1960 | Worthington | 401/37 |
| 3,556,667 | 1/1971 | Kaufman | 401/196 X |

*Primary Examiner*—Lawrence Charles

[57] ABSTRACT

A waxing and polishing apparatus is provided which includes a spherically-shaped body of elastically resilient material and a spherically-shaped housing being adapted to enclose the spherically-shaped body. The spherically-shaped body includes a cavity therein that cooperates with a first portion of the spherical surface of the body to define a wall therebetween; and a plurality of fluid-communicating apertures are provided which interconnect the cavity and the first portion of the spherical surface. A passage is provided which intercommunicates the cavity with a second portion of the spherical surface distal from the first portion and a plug is provided for removably plugging the passage.

The spherically-shaped housing includes a first shell of substantially hemispherical shape sized to encase and to conform with a first half of the body, a second shell of substantially hemispherical shape sized to nest on the outside of the first shell, and first and second pivot pins pivotally interconnecting the shells to permit the shells to be relatively positioned to form a spherical case enclosing the body and to permit the shells to be nested to expose a substantially hemispherical portion of the body.

5 Claims, 3 Drawing Figures

WAXING AND POLISHING APPARATUS

BACKGROUND OF THE INVENTION

Field of the Invention

This invention relates generally to apparatus for applying liquid wax and for providing a polishing surface for buffing the wax, and more particularly to an elastically resilient body having a liquid wax-receiving cavity therein, and a porous wax-feeding wall between the cavity and an outer surface of the body.

SUMMARY OF THE INVENTION

In accordance with the broader aspects of this invention, there is provided a waxing and polishing apparatus which includes a spherically-shaped body of elastically resilient material. A wax-receiving cavity is provided in the body which cooperates with a first portion of the spherical surface of the body to define a wall therebetween. A plurality of fluid-communicating apertures are provided in the wall which interconnect the cavity with the first portion of the spherical surfaces. A passage is provided in the body which interconnects the cavity with a second portion of the spherical surface which is distal from the first portion; and a plug is provided for removably plugging the passage.

A spherically-shaped housing is provided for encasing the spherically-shaped body. This spherically-shaped body includes a first shell of substantially hemispherical shape which is sized to encase and to conform with the body and a second shell of substantially hemispherical shape which is sized to nest on the outside of the first shell. The housing also includes first and second pivot pins which interconnect the shells on a substantially hemispherical plane and thereby permit the shells to be relatively positioned to form a spherical housing enclosing the body and to permit the shells to be relatively rotated and nested to selectively expose a substantially hemispherical portion of the body.

It is an object of this invention to provide a spherically-shaped waxing and polishing apparatus which includes a spherically-shaped housing and a spherically-shaped body of elastically resilient material having a liquid wax-receiving cavity therein.

It is another object of this invention to provide a spherically-shaped body of elastically resilient material having a wax-receiving cavity therein and a plurality of fluid-communicating apertures interconnecting the cavity with a first portion of the surface of the spherically-shaped body.

It is still another object of this invention to provide a waxing and polishing apparatus which includes a spherically-shaped housing comprising first and second hemispherically-shaped shells which are adapted to be relatively rotated to form a spherical case and to be relatively rotated and thereby to open the housing.

The above-mentioned and other features and objects of this invention and the manner of obtaining them will become more apparent and the invention itself will be best understood by reference to the following description of an embodiment of the invention taken in conjunction with the accompanying drawings.

DESCRIPTION OF THE PREFERRED EMBODIMENT

Figure 1:
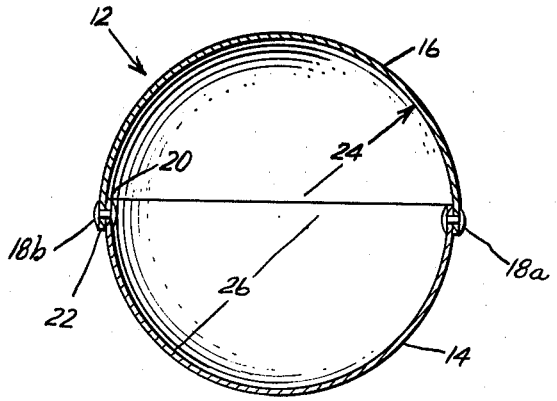
FIG. 1 is a cross-section of the housing showing the shells relatively positioned to form a complete sphere.

Referring now to the drawings, the waxing and polishing apparatus includes a spherically-shaped body assembly 10 and a spherically-shaped housing 12 which may be opened for insertion and removal of the body assembly 10 and which may be closed for storing the body assembly 10.

Figure 2:
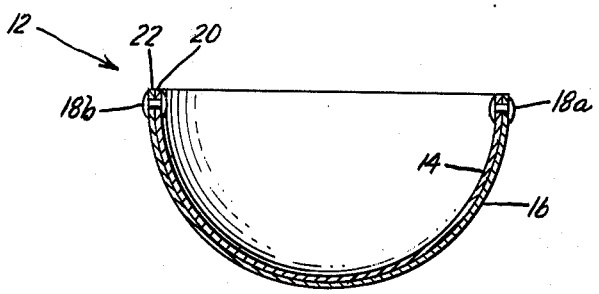
FIG. 2 is a cross-section of the housing showing the hemispherically-shaped shells thereof in the nested position.

Referring now to FIGS. 1 and 2, the spherically-shaped housing 12 includes a first hemispherically-shaped shell 14 and a second hemispherically-shaped shell 16 being pivotally interconnected by a pair of pivot pins 18*a* and 18*b*, the pivot pins 18*a* and 18*b* being positioned on an axis of the sphere which is substantially parallel to edges 20 and 22 of the shells 14 and 16 respectively; and the shell 16 has an inside radius 24 which is slightly in excess of an outside radius 26 of the shell 14. Thus the shells 14 and 16 can be relatively positioned as shown in FIG. 2 for insertion and removal of the body assembly 10.

Figure 3:
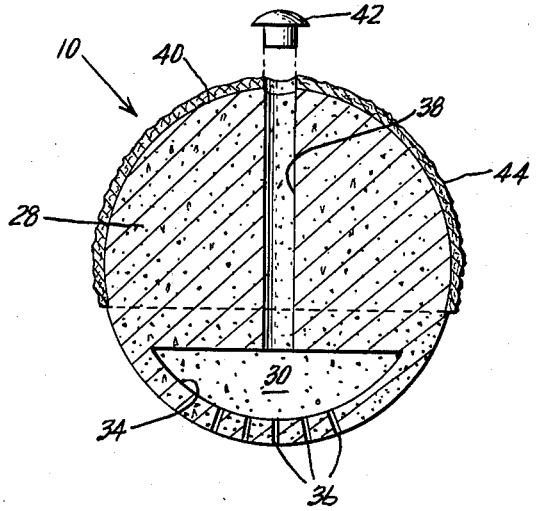
FIG. 3 is a cross-section of the spherically-shaped body assembly and the wax-receiving cavity therein.

Referring now to FIG. 3, the spherically-shaped body assembly 10 includes a spherically-shaped body 28 of elastically resilient material which is preferably of a sponge-like plastic material having porous openings therethrough, a wax-receiving cavity 30 in the body 28 which cooperates with a first portion 32 of the body 28 to define a wall 34 between the cavity 30 and the first portion 32, a plurality of fluid-communicating apertures or holes 36 which communicate the cavity 30 with the first portion 32, a passage 38 which communicates the cavity 30 with a second portion 40 of the spherical surface of the body 28, a plug 42 in the passage 38 which provides means for removably plugging the passage 38, and a polishing cover of terrycloth or the like 44 which is preferably removable for washing and which covers a hemispherical portion of the body 28 distal from the first portion 32.

In use, the spherically-shaped housing 12 of FIG. 1 is opened by relatively positioning the shells 14 and 16 as shown in FIG. 2 for removal of the spherically-shaped body assembly 10 of FIG. 3. The plug 42 is removed from the passage 38, the cavity 30 is filled with liquid wax, or other suitable cleaning or waxing material, through the passage 38, the plug 42 is inserted into the passage 38, wax is applied to a work surface (not shown) through the apertures or holes 36 which may comprise porosity in the material of the spherically-shaped body 28 and the wall 34 thereof, and the work surface is subsequently polished by rubbing the body assembly 10 over the work surface with the polishing cover 44 contacting the work surface.

Alternatively, after the cavity 30 has been filled with liquid wax or the like, and the plug 42 has been inserted, the body assembly 10 is inserted into the housing 12 with the sections 14 and 16 nested as shown in FIG. 2. When so inserted, the body assembly 10 should be so oriented that the passage 38 is upright thereby placing the cavity 30 in the lower portion of the shell 14. The outer shell 16 may then be swung to the position shown in FIG. 1 thereby completely encasing the body assembly 10 for storage and later use.

When it is desired to use the device for waxing and polishing, the shells 14 and 16 are swung to cover the upper portion of the body assembly 10 as shown in FIG. 3 so as to cover the upper half thereof, or in other words, the portion covered with the polishing cloth 44. This leaves exposed the lower cavity portion 30 of the sponge body 28. The shells 14 and 16 are thereupon manually grasped and the device manipulated to engage the exposed body portion with the work surface. This causes the liquid wax in the cavity 30 to exude through the pores in the body 28 and also the passages 36 onto the work surface. The work surface is forcefully rubbed as is customary. In a further embodiment, the passages 36 may be omitted, relying on the pores in the wall to pass the liquid wax.

When it is desired to polish the work surface, the shells 14 and 16 are moved to nested position to cover only the lower cavity portion of the sponge body 28 thereby leaving exposed the sponge backed cloth surface 44. The shells are once again manually grasped and manipulated to engage forcefully the cloth surface 44 against the work surface. When the waxing and polishing operations are completed, the two shells 14 and 16 are extended to the spherical configuration of FIG. 1 so as to enclose the body assembly 10.

The present invention provides a useful and attractive waxing and polishing apparatus that feeds liquid wax to a resilient applicator surface, that provides a buffing or polishing surface with a resilient backing, and that includes a housing of unique and attractive design for storing the apparatus.

While there have been described above the principles of this invention in connection with specific apparatus, it is to be clearly understood that this description is made only by way of example and not as a limitation to the scope of the invention.

What is claimed is:

1. A waxing and polishing apparatus comprising a spherically-shaped body of elastically resilient material having a cavity therein that cooperates with a first portion of the spherical surface of said body to define a wall therebetween, having a plurality of fluid-communicating apertures for fluid dispersal upon a forceful rubbing applied to said body, said apertures interconnecting said cavity and said first portion, and having a passage interconnecting said cavity and a second portion of said spherical surface distal from said first portion;

means for removably plugging said passage; and a spherically-shaped housing comprising a first shell of substantially hemispherical shape sized to encase and to conform with said body, a second shell of substantially hemispherical shape sized to nest with said first shell on the outside thereof, and means for pivotally interconnecting said shells to permit said shells to be relatively positioned to form a spherical case enclosing said body and to permit said shells to be nested in a first position thereby selectively exposing said apertures for fluid dispersal and nested in a second position thereby selectively covering said apertures and exposing a second portion of body surface for polishing.

2. The device of claim 1 in which said wall comprises a sponge-like material.

3. The device of claim 1 in which said body comprises a sponge-like material having porous openings therethrough, and said fluid-communicating apertures comprise said porous openings.

4. The device of claim 1 in which said device includes a polishing cover of substantially hemispherical shape covering said second portion of body surface.

5. The device of claim 1 in which said elastically resilient material comprises sponge-like material having porous openings therethrough, said fluid-communicating apertures comprise said porous openings, said plugging means comprises a plastic plug adapted for press fitting into said passage, said interconnecting means comprises a first pivot pin intersecting both of said shells on a substantially hemispherical plane between said shells and a second pivot pin intersecting both of said shells on said hemispherical plane and on a second hemispherical plane orthogonal to said first plane and intersecting said first pivot pin, and said device includes a polishing cover of substantially hemispherical shape covering said second portion of body surface.

* * * * *